US007080631B2

(12) United States Patent
Hanyu

(10) Patent No.: US 7,080,631 B2
(45) Date of Patent: Jul. 25, 2006

(54) SAFETY FUEL INJECTION PUMP

(75) Inventor: Toshiharu Hanyu, Obu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/923,012

(22) Filed: Aug. 23, 2004

(65) Prior Publication Data

US 2005/0076888 A1 Apr. 14, 2005

(30) Foreign Application Priority Data

Oct. 8, 2003 (JP) ..... 2003-349915

(51) Int. Cl.
*F02M 37/04* (2006.01)

(52) U.S. Cl. ..... 123/495; 123/198 D; 464/32

(58) Field of Classification Search ..... 123/495, 123/507, 508, 198 D, 198 DB; 417/223; 464/30, 32 X See application file for complete search history.

(56) References Cited

U.S. PATENT DOCUMENTS 3,824,899 A * 7/1974 Dzioba ..... 91/491
4,218,896 A * 8/1980 van der Lely ..... 464/32
5,171,131 A * 12/1992 Niemiec ..... 417/283
5,630,398 A * 5/1997 Gant et al. ..... 123/450
6,004,106 A * 12/1999 Machida et al. ..... 417/223
6,145,429 A * 11/2000 Paul ..... 92/33
6,149,073 A * 11/2000 Hickey et al. ..... 239/89
RE37,632 E * 4/2002 Bouchauveau et al. ..... 123/458
2003/0044288 A1* 3/2003 Utsumi ..... 417/199.1

FOREIGN PATENT DOCUMENTS

JP 2002-250459 9/2002

* cited by examiner

*Primary Examiner*—Carl S. Miller
(74) *Attorney, Agent, or Firm*—Nixon & Vanderhye PC

(57) ABSTRACT

A fuel injection pump includes a camshaft, an eccentric cam, a cam ring, a housing and plungers. The camshaft is rotated by an engine. The cam is provided separately from the camshaft and is formed with a connecting portion connected with the main shaft. The cam rotates with the camshaft. The cam ring revolves around the camshaft so that the cam ring rotates with respect to the cam along an outer periphery of the cam. The housing rotatably houses the cam and the cam ring and is formed with fuel pressurizing chambers. The plungers reciprocate in accordance with the revolution of the cam ring to pressurize and to pressure-feed fuel drawn into the fuel pressurizing chambers. Strength of the connecting portion is set to a value lower than damage strength of the housing.

14 Claims, 3 Drawing Sheets

SAFETY FUEL INJECTION PUMP

CROSS REFERENCE TO RELATED APPLICATION

This application is based on and incorporates herein by reference Japanese Patent Application No. 2003-349915 filed on Oct. 8, 2003.

BACKGROUND OF THE INVENTION

1. Field of the Invention

The present invention relates to a fuel injection pump. For instance, the present invention can be suitably applied to a fuel injection pump used in an accumulation type fuel injection system of a diesel engine.

2. Description of Related Art

There is a fuel injection pump having a main shaft, a cam ring and at least one plunger, for instance, as disclosed in Unexamined Japanese Patent Application Publication No. 2003-148295 (Patent Document 1, hereafter) or No. 2002-250459 (Patent Document 2, hereafter). As shown in FIG. 5, a cam 144 having a circular section is integrally formed on the main shaft 110. The cam ring is rotatably fitted to an outer periphery of the cam 144 through a bush. The plunger is held inside a cylinder so that the plunger can reciprocate in the cylinder. If an engine drives the maim shaft 110 to rotate, the rotational movement of the cam 144 is transmitted to the plunger through the cam ring. Thus, the plunger reciprocates inside the cylinder and pressure-feeds the fuel. The fuel injection pump has two fuel pressurizing chambers, which are alternately pressurized by the two reciprocating plungers. The fuel injection pump has discharge valves for alternately discharging the fuel pressurized in the fuel pressurizing chambers.

In the technology disclosed in Patent Document 1, a restriction portion is formed in a bypass passage leading from a feed pump to a cam chamber for restricting a quantity of lubrication fuel supplied into the cam chamber. Thus, a feeding pressure required to fill the fuel pressurizing chamber with the fuel is ensured even when rotation speed is low. The restriction portion is formed so that a flow passage of the restriction portion is not blocked completely even if extraneous matters included in the fuel reach the restriction portion.

The fuel injection pump disclosed in Patent Document 2 includes a suction quantity control electromagnetic valve for supplying the fuel into the fuel pressurizing chamber and for controlling the quantity of the fuel pressurized and pressure-fed by the plunger. A valve member and an armature of the suction quantity control electromagnetic valve are formed with penetration passages axially penetrating the valve member and the armature. The suction quantity control electromagnetic valve is formed with a communication passage for connecting an upstream passage of control fuel with an armature chamber. Since a flow of the fuel is generated in the armature chamber, the fuel will not stay around the armature. Therefore, even if the extraneous matters included in the fuel exist in the armature chamber, the extraneous matters will be discharged outward along the flow of the fuel.

The above technologies can prevent blocking of the fuel lubrication bypass passage leading to the cam chamber or defective operation of the suction quantity control electromagnetic valve due to the extraneous matters included in the fuel. However, there is a possibility that the extraneous matters get stuck among operating members such as the cam, the cam ring, the plunger, the suction valve and the discharge valve, which are disposed downstream of the fuel lubrication bypass passage and housed in the cam chamber or are disposed downstream of the suction quantity control electromagnetic valve for performing rotation movement, reciprocating movement and the like. If water and the like are accidentally mixed into the fuel, there is a possibility that poor lubrication (deterioration of lubricity) occurs among the sliding members such as the plunger housed in the cam chamber. The poor lubrication between the plunger and an inner peripheral surface of a plunger sliding hole can cause seizing of the plunger. The seizing of the plunger triggers seizing of sliding surfaces of the plunger and the cam ring, which revolves. As a result, there is a possibility that an excessive thrust force is applied to the cam ring and the plunger is damaged.

If the extraneous matters get stuck at a seat portion of the operating member such as the suction valve or the discharge valve, fluid-tightness of a sealing portion cannot be ensured and an appropriate pressure-feeding quantity (a discharging quantity) of the fuel cannot be obtained. In addition, high pressure of the continuously pressurized fuel is applied to the plunger. If the high pressure of the fuel is continuously applied to the plunger, the poor lubrication can occur between the plunger and the inner peripheral surface of the plunger sliding hole and the seizing of the plunger can be caused. In this case, there is a possibility that the excessive thrust force is applied to the cam ring and the plunger is damaged.

If the plunger is damaged, there is a possibility that fragments of the damaged plunger move through the cam chamber and get stuck into a clearance between the housing and the cam ring. In this case, if the housing is made of aluminum, there is a possibility that the housing is damaged and the damage spreads.

In order to prevent the above trouble, the clearance between the housing and the cam ring can be enlarged. However, in this case, body size is increased to a large extent. Therefore, cost will be increased and mountability to a vehicle and the like will be deteriorated.

In the case where the fuel is stored in a metal drum and the like and is supplied from the metal drum to the vehicle, the water can be accidentally mixed into the fuel. The water easily accumulates in the bottom of the metal drum. Therefore, there is a possibility that the fuel including a large amount of water is used in the fuel injection pump if the fuel is supplied from the metal drum.

SUMMARY OF THE INVENTION

It is therefore an object of the present invention to provide a safety fuel injection pump capable of preventing spread of damage when water or extraneous matters accidentally mixed into fuel cause defective operation of a plunger and the like.

According to an aspect of the present invention, a fuel injection pump includes a main shaft, a cam, a cam ring, a chousing and a plunger. The main shaft is rotated by an internal combustion engine. The cam is provided separately from the main shaft. The cam is formed with a connecting portion connected to the main shaft, so the cam can rotate integrally with the main shaft. The cam ring revolves around the main shaft so that the cam ring rotates with respect to the cam along an outer periphery of the cam. The housing rotatably houses the cam and the cam ring and is formed with a fuel pressurizing chamber. The plunger reciprocates in accordance with the revolution of the cam ring to pressurize and to pressure-feed the fuel drawn into the fuel pressurizing chamber. Strength of the connecting portion is set to a value lower than damage strength of the housing, at which the housing is damaged.

In the above structure, the main shaft, which is rotated by the internal combustion engine, and the cam, which rotates integrally with the main shaft, are formed separately. The rotation of the cam is transmitted in the form of the reciprocation of the plunger. Further, the connecting portion for connecting the main shaft with the cam is formed. Since the strength of the connecting portion is set to a value lower than the damage strength of the housing, the main shaft and the cam can be separated from each other before the housing is damaged. If the connected state is eliminated and the main shaft and the cam are separated from each other, the main shaft freely turns in the cam. Therefore, even if the main shaft is driven by the internal combustion engine, the rotational movement of the main shaft is not transmitted to the cam, and the function of the fuel injection pump is stopped. As a result, the damage of the housing can be prevented and the spread of the damage can be prevented.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS (First Embodiment)

Figure 1:
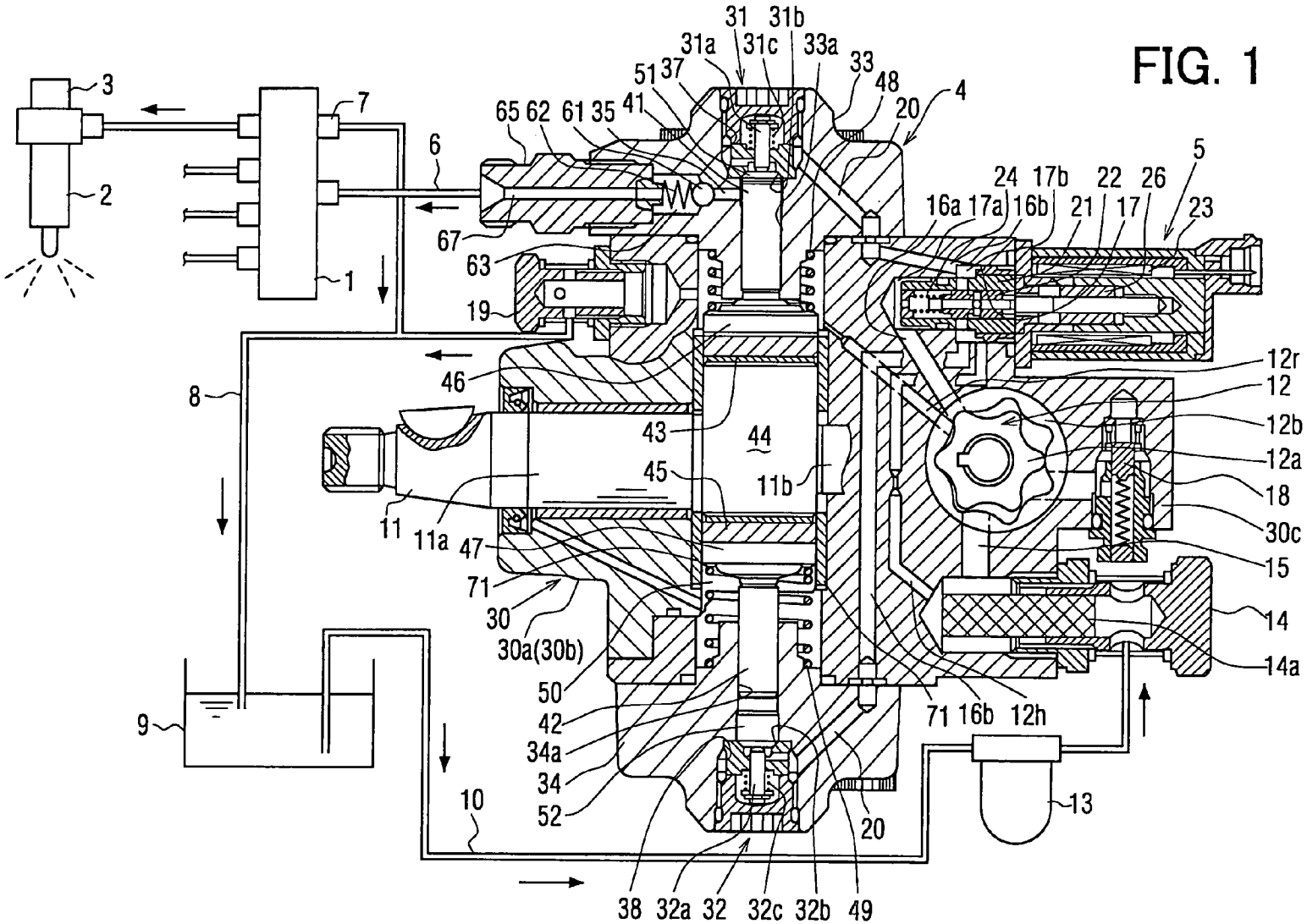
FIG. 1 is a partly sectional fragmentary schematic illustration showing a common rail type fuel injection system having a fuel injection pump according to a first embodiment of the present invention.

Referring to FIG. 1, a common rail type fuel injection system (an accumulation type fuel injection system) having a fuel injection pump (a supply pump) according to a first embodiment of the present invention is illustrated.

The common rail type fuel injection system shown in FIG. 1 is used in an internal combustion engine such as a multi-cylinder (four-cylinder, in FIG. 1) diesel engine. The fuel injection system accumulates high-pressure fuel in a common rail 1 and injects the accumulated high-pressure fuel into combustion chambers of respective cylinders of the engine through multiple injectors (electromagnetic fuel injection valves) 2 mounted in accordance with the respective cylinders of the engine. In FIG. 1, only one injector 2 corresponding to one of the cylinders of the four-cylinder engine is illustrated.

The common rail type fuel injection system includes the common rail 1, the multiple injectors 2, the fuel injection pump (the supply pump) 4 and a control device (an electronic control unit, or an ECU) as controlling means. The common rail 1 accumulates the high-pressure fuel. The injectors 2 are mounted on the respective cylinders of the engine and inject the high-pressure fuel accumulated in the common rail 1 into the combustion chambers of the respective cylinders. The supply pump 4 pressurizes the fuel and supplies the fuel toward the common rail 1. The ECU controls valve opening operation and valve closing operation of the multiple injectors 2 (more specifically, electromagnetic valves 3) and the supply pump 4 (more specifically, a suction quantity control electromagnetic valve 5), for instance.

In order to continuously accumulate the fuel in the common rail 1 at a high pressure corresponding to a fuel injection pressure, the high-pressure fuel is pressure-fed from the supply pump 4 into the common rail 1 through a high-pressure fuel pipe 6. A fuel pressure sensor and a pressure limiter 7 are mounted to the common rail 1. The fuel pressure sensor senses the fuel pressure in the common rail 1 (a common rail pressure). If the common rail pressure exceeds a limit set pressure, the pressure limiter 7 opens in order to limit the common rail pressure under the limit set pressure.

The fuel injection from the injector 2 into the combustion chamber is controlled by energizing and de-energizing the electromagnetic valve 3. The electromagnetic valve 3 controls the fuel pressure in a back pressure control chamber, which drives a command piston moving with a nozzle needle. More specifically, while the electromagnetic valve 3 of the injector 2 is energized and the nozzle needle is opened, the high-pressure fuel accumulated in the common rail 1 is supplied into the combustion chamber of each cylinder through the injection. Thus, the engine is operated.

Surplus fuel such as leak fuel from a high-pressure fuel system including the injectors 2, the supply pump 4 and the pressure limiter 7 is returned to a fuel tank 9 through a fuel return passage 8.

Next, structure of the supply pump 4 will be explained based on FIGS. 1 to 3. As shown in FIG. 1, the supply pump 4 includes a camshaft (a main shaft) 11 as a pump drive shaft, a cam (an eccentric cam) 44 capable of rotating with the camshaft 11, a cam ring 45 revolving around the camshaft 11 along an outer periphery of the cam 44, first and second plungers 41, 42, a rotary pump 12, the suction quantity control electromagnetic valve 5 as a control valve, check valves 31, 32 as first and section section valves 31, 32, discharge valves 61 and a housing 30, in which the above components are housed or mounted.

Figure 2A:
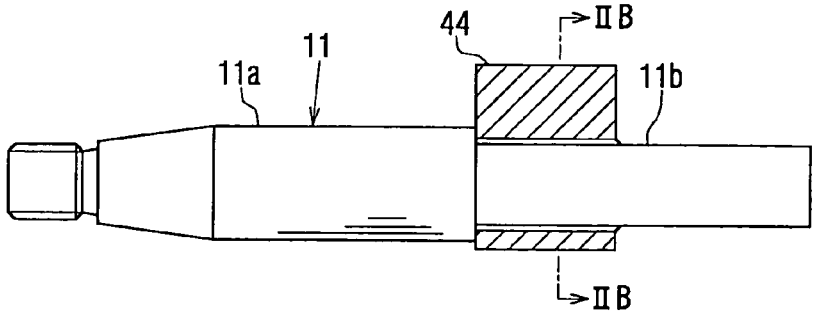
FIG. 2A is a longitudinal partly sectional view showing a main shaft and a cam of the fuel injection pump according to the first embodiment.
Figure 2B:
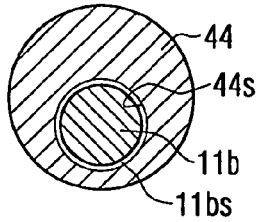
FIG. 2B is a cross-sectional view showing the main shaft and the cam of FIG. 2A taken along the line IIB—IIB.

As shown in FIG. 1, the camshaft 11 as the pump drive shaft rotated by the engine is rotatably held in the housing 30. A drive pulley is attached to an outer periphery of a tip end (the left end in FIG. 1) (a large diameter shaft portion) 11*a* of the camshaft 11. The drive pulley is linked with a crank pulley of a crankshaft of the engine through a drive force transmitting member such as a belt and is driven. The rotary pump (a feed pump) 12 for supplying the low-pressure fuel is connected to the other tip end (the right end in FIG. 1) (a small diameter shaft portion) 11*b* of the camshaft 11. The cam (the eccentric cam) 44 is connected to the small diameter shaft portion 11*b*, or an outer periphery of an intermediate portion of the camshaft 11, as shown in FIGS. 1 and 2A. The eccentric cam 44 can rotate integrally with the camshaft 11. The eccentric cam 44 is disposed eccentrically with respect to the axial center of the camshaft 11 and has a substantially circular section. A male screw 11*bs* and a female screw 44*s* are respectively formed on the outer periphery of the small diameter shaft portion 11*b* and the inner periphery of the eccentric cam 44 as shown in FIGS. 2A and 2B. The male screw 11*bs* of the camshaft 11 can be screwed into the female screw 44*s* of the eccentric cam 44. The rotation direction of the camshaft 11 coincides with the direction of screwing the male screw 11*bs* into the female screw 44*s*. The large diameter shaft portion 11*a* and the small diameter shaft portion 11*b* having different external diameters constitute the camshaft 11.

The male screw 11*bs* and the female screw 44*s* constitute a connecting portion 11*bs*, 44*s*, which is brought to a connected state through thread fastening. Strength of the connecting portion 11*bs*, 44*s* is set to a value lower than damage strength of the housing 30 (more specifically, a first housing portion 30*a* made of aluminum). The damage strength is a stress value at which the housing 30 (more specifically, the first housing portion 30*a*) is damaged. The strength of the connecting portion 11*bs*, 44*s* should be preferably set so that the connected state of the connecting portion 11*bs*, 44*s* is eliminated if the seizing occurs between the sliding surfaces of the cam ring 45 and the plungers 41, 42 (more specifically, plate members 46, 47). Further, the strength of the connecting portion 11*bs*, 44*s* should be preferably set so that the connecting state of the connecting portion 11*bs*, 44*s* is eliminated if the seizing occurs between the plungers 41, 42 and inner peripheral surfaces of sliding holes 33*a*, 34*a*.

The camshaft 11 and the eccentric cam 44 constitute separable structure through the connecting portion 11*bs*, 44*s*. The separable structure can rotate integrally. The connecting portion 11*bs*, 44*s* has a connection eliminating function of eliminating the connected state of the connecting portion 11*bs*, 44*s*, or the connected state between the camshaft 11 and the eccentric cam 44, if load torque (drive torque) greater than a predetermined connection permitting strength is applied to the camshaft 11 or if a destructive force greater than the predetermined connection permitting strength is applied to the eccentric cam 44. The camshaft 11 and the eccentric cam 44 constitute the camshaft capable of stopping the function of the fuel injection pump if the defective operation of the operating members such as the plungers 41, 42 occurs. Thus, the spread of the damage such as the damage of the housing 30 can be prevented.

The feed pump 12 rotates integrally with the camshaft 11 and draws the fuel from the fuel tank 9 through a fuel supply passage 10. In FIG. 1, the feed pump 12 is illustrated in a state in which the feed pump 12 is rotated by an angle of 90°. The feed pump 12 may have any type of pump structure such as vane type pump structure, instead of the inner gear type pump structure shown in FIG. 1. The inner gear type pump 12 includes an inner rotor 12*a*, which is fitted to the camshaft 11 with a clearance, and an outer rotor 12*b*, which is driven by the inner rotor 12*a* in sun-and-planet motion.

A fuel filter 13 is disposed in the fuel supply passage 10. The fuel filter 13 filters or traps impurities in the fuel drawn from the fuel tank 9 into the feed pump 12.

As shown in FIG. 1, an inlet (a fuel inlet portion) 14 and a fuel introduction passage 15 are formed on a suction side of the feed pump 12. The inlet 14 includes a sleeve nipple and a screw and introduces the fuel into the housing 30 from the outside. The fuel introduction passage 15 connects the inlet 14 with the feed pump 12. The inlet 14 incorporates a filter 14*a* as shown in FIG. 1. A discharge side of the feed pump 12 is connected with the suction quantity control electromagnetic valve 5 (more specifically, a fuel sump chamber 17*a* on the tip end side of the suction quantity control electromagnetic valve 5) through a fuel leading passage 16*a*. The fuel pump chamber 17*a* is a space provided by an accommodation hole 17 of the suction quantity control electromagnetic valve 5 formed in the housing 30 and the tip end portion ( the left end in FIG. 1) of the suction quantity control electromagnetic valve 5 accommodated in the accommodation hole 17. The accommodation hole 17 is a stepped hole having a bottom. The accommodation hole 17 is provided by a hole portion with the bottom having substantially the same internal diameter as a valve housing 21 explained after, and a control fuel storage portion, whose internal diameter is larger than the hole portion. A space defined by the valve housing 21 and the control fuel storage portion provides a control fuel (low-pressure fuel) storage chamber 17*b*.

A pressure regulation valve (a regulation valve) 18 is disposed near the feed pump 12 as shown in FIG. 1. The regulation valve 18 prevents the discharging pressure of the low-pressure fuel discharged from the feed pump 12 into the fuel sump chamber 17*a* of the suction quantity control electromagnetic valve 5 from exceeding a predetermined fuel pressure.

The suction quantity control electromagnetic valve 5 is a normally-open type electromagnetic flow control valve as shown in FIG. 1. The suction quantity control electromagnetic valve 5 has a valve member (a valve) 22, which is slidably held inside the sleeve-shaped valve housing 21, an electromagnetic driving portion 23 as valve driving means for driving the valve 22 in a valve closing direction, and a coil spring 24 as valve biasing means for biasing the valve 22 in a valve opening direction. When energized, the electromagnetic driving portion 23 generates an electromagnetic force and attracts a movable member (an armature) 26, which moves with the valve 22. The valve 22 is opened by the biasing force of the coil spring 24 when the electromagnetic driving portion 23 is de-energized. If the electromagnetic driving portion 23 is energized, the valve 22 opens against the biasing force of the coil spring 24. The valve 22 and the valve housing 21 provide a valve portion for performing valve opening operation and valve closing operation.

Instead of the electromagnetic flow control valve shown in FIG. 1, any type of electromagnetic valve can be employed as the suction quantity control electromagnetic valve 5 if the suction quantity control electromagnetic valve 5 has the valve portion 21, 22 for streaming or blocking the control fuel, and the electromagnetic driving portion 23 for driving the valve portion 21, 22 to perform the valve opening operation and the valve closing operation. The clearance between the valve 22 and the valve housing 21 and an armature chamber accommodating the armature 26 of the electromagnetic driving portion 23 should be preferably formed so that the fuel flows through the clearance and the armature chamber without staying there.

As shown in FIG. 1, surplus fuel, which is generated through the control of the flow of the fuel performed by the suction quantity control electromagnetic valve 5, is returned to the suction side of the feed pump 12 through a fuel return passage 12*h* connected to the suction quantity control electromagnetic valve 5, and the fuel introduction passage 15. Part of the fuel discharged from the feed pump 12 is introduced into the cam chamber 5 through a fuel lubrication passage 12*r* connected to the feed pump 12 and lubricates various sliding members such as the plungers 41, 42. Then, the fuel flows out of the supply pump 4 through an outlet (a fuel outlet portion) 19, which is provided by a sleeve nipple and a screw. The fuel flowing out of the outlet 19 is returned to the fuel tank 9 through the fuel return passage 8. The fuel return passage 12*h* and the fuel introduction passage 15 constitute a fuel suction passage for introducing the fuel into the feed pump 12. The fuel lubrication passage 12*r* and the cam chamber 50 constitute a return fuel passage for lubricating the various sliding portions of the various operating members and for returning the surplus fuel.

As shown in FIG. 1, the control fuel (the low-pressure fuel) controlled by the suction quantity control electromagnetic valve 5 flows out to the control fuel storage chamber 17*b*. The low-pressure fuel is drawn into multiple fuel pressurizing chambers 51, 52 through multiple (two, in FIG. 1) control fuel passages 16*b* and the multiple suction valves 31, 32. More specifically, the control fuel storage chamber 17*b* communicates with the control fuel passage 16*b* and the fuel suction passage 20 in that order. The fuel suction passage 20 communicates with one of the suction valves 31, 32. The fuel pressurizing chambers 51, 52 are spaces defined by the plungers 41, 42 and the suction valves 31, 32 for storing the fuel. The number of the control fuel passages 16*b* or the fuel suction passages 20 is set in accordance with the number of the fuel pressurizing chambers 51, 52 (more specifically, the number of the plungers 41, 42).

The first suction valve 31 and the first fuel pressurizing chamber 51 correspond to the first plunger 41. The second suction valve 32 and the second fuel pressurizing chamber 52 correspond to the second plunger 42.

The fuel leading passage 16*a*, the fuel sump chamber 17*a*, the control fuel storage chamber 17*b*, the control fuel passage 16*b* and the fuel suction passage 20 constitute the low-pressure fuel passage. The suction quantity control electromagnetic valve 5 is disposed in the low-pressure fuel passage.

The first suction valve 31 is a check valve, whose forward direction coincides with the flow direction of the fuel flowing from the feed pump 12 toward the first fuel pressurizing chamber 51. The first suction valve 31 includes a valve member 31*a* and a coil spring 31*c* as biasing means for biasing the valve member 31*a* in a direction for seating the valve member 31*a* on a valve seat 31*b*. The first suction valve 31 functions as a check valve for presenting backflow of the fuel from the first fuel pressurizing chamber 51 toward the suction quantity control electromagnetic valve 5. In a normal state, the valve member 31*a* is biased by the biasing force of the coil spring 31*c* upward in FIG. 1 and is seated on the valve seat 31*b*. Thus, the first suction valve 31 is closed. If the low-pressure fuel flows in from the suction quantity control electromagnetic valve 5 through the fuel suction passage 20, the fuel pressure of the low-pressure fuel opens the valve member 31*a* and the fuel is drawn into the first fuel pressurizing chamber 51. If the first plunger 41 moves and pressurizes the fuel in the first fuel pressurizing chamber 51, the valve member 31*a* of the first suction valve 31 is closed by the fuel pressure in the first fuel pressurizing chamber 51, and the state is retained until the pressure-feeding of the fuel is finished.

Likewise, the second suction valve 32 is a check valve, whose forward direction coincides with the flow direction of the fuel flow from the feed pump 12 toward the second fuel pressurizing chamber 52. The second suction valve 32 includes a valve member 32*a* and a coil spring 32*c* as biasing means for biasing the valve member 32*a* in a direction for seating the valve member 32*a* on a valve seat 32*b*. The second suction valve 32 functions as a check valve for preventing backflow of the fuel from the second fuel pressurizing chamber 52 toward the suction quantity control electromagnetic valve 5. In a normal state, the valve member 32*a* is biased by the biasing force of the coil spring 32*c* downward in FIG. 1 and is seated on the valve seat 32*b*. If the low-pressure fuel flows in from the suction quantity control electromagnetic valve 5 through the fuel suction passage 20, the fuel pressure of the low-pressure fuel opens the valve member 32*a* and the fuel is drawn into the second fuel pressurizing chamber 52. If the second plunger 42 moves and pressurizes the fuel in the second fuel pressurizing chamber 52, the valve member 32*a* of the second suction valve 32 is closed by the fuel pressure in the second fuel pressurizing chamber 52, and the state is retained until the pressure-feeding of the fuel is finished.

In the present embodiment, the first suction valve 31 is disposed short of the first fuel pressurizing chamber 51 in the low-pressure fuel passage. More specifically, the first suction valve 31 is disposed at a point where the first suction valve 31 and the first plunger 41 define the first fuel pressurizing chamber 51. Instead, the first suction valve 31 may be disposed in the fuel suction passage 20 connected to the first fuel pressurizing chamber 51.

The second suction valve 32 is disposed short of the second fuel pressurizing chamber 52 in the low-pressure fuel passage. More specifically, the second suction valve 32 is disposed at a point where the second suction valve 32 and the second plunger 42 define the second fuel pressurizing chamber 52. Instead, the second suction valve 32 may be disposed in the fuel suction passage 20 connected to the second fuel pressurizing chamber 52.

The two plungers 41, 42 are disposed at substantially symmetric positions across the eccentric cam 44 on the outer periphery of the intermediate portion of the camshaft 11, along a vertical direction in FIG. 1.

Figure 3:
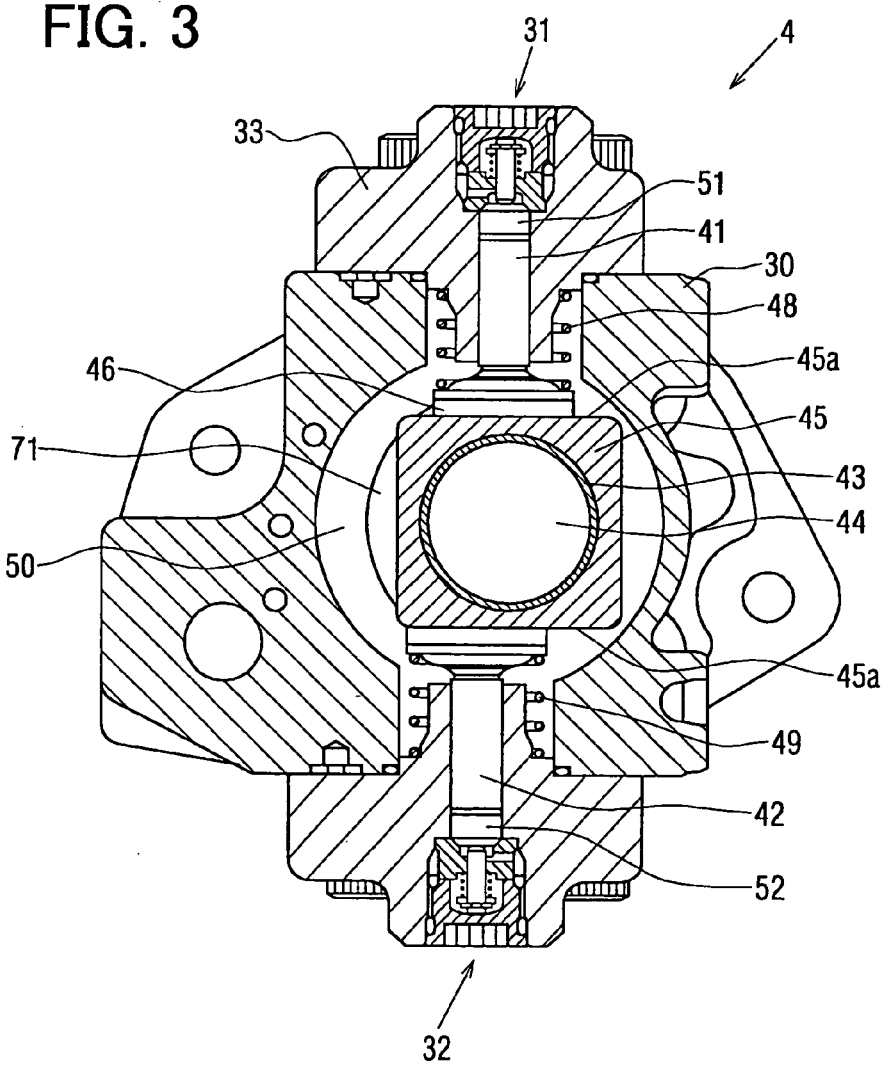
FIG. 3 is a cross-sectional view showing the fuel injection pump according to the first embodiment.

As shown in FIG. 3, the cam ring 45 having a substantially rectangular profile is slidably held on the outer periphery of the eccentric cam 44 through a ring-shaped bush 43. A hollow portion having a substantially circular section is formed in the cam ring 45. The bush 43 and the eccentric cam 44 are housed inside the hollow portion. The plate members 46, 47 respectively integrated with the two plungers 41, 42 are disposed respectively on the upper and lower end surfaces 45*a* of the cam ring 45 as shown in FIG. 3. The plate members 46, 47 are pressed against the upper and lower end surfaces 45*a* of the cam ring 45 by biasing forces of coil springs 48, 49, which are disposed around the outer peripheries of the plungers 41, 42 respectively. The plate members 46, 47 and the cam ring 45 can provide relative movement in a lateral direction in FIG. 3 in a sliding manner on the surfaces thereof, in accordance with the revolution of the cam ring 45. The eccentric cam 44 and the cam ring 45 are made of metallic material and are rotatably housed inside the cam chamber 50 formed in the housing 30.

As shown in FIG. 1, the plungers 41, 42 are housed in sliding holes of the housing 30 (more specifically, sliding holes 33*a*, 34*a* of second housing portions 33, 34) respectively so that the plungers 41, 42 can reciprocate in a sliding manner. The first fuel pressurizing chamber 51 is provided by an inner peripheral surface of the slidinghole 33*a* and the first suction valve 31 (more specifically, the valve member 31*a*) on the upper end surface of the first plunger 41 in FIG. 1. The second fuel pressurizing chamber 52 is provided by an inner peripheral surface of the sliding hole 34*a* and the second suction valve 32 (more specifically, the valve member 32*a*) on the lower end surface of the second plunger 42 in FIG. 1.

The first discharge valve 61 is connected with the first fuel pressurizing chamber 51 through a first fuel pressure-feeding passage 35. The second discharge valve is connected with the second fuel pressurizing chamber 52 through a second fuel pressure-feeding passage. The first discharge valve 61 and the second discharge valve function as check valves for preventing backflow of the high-pressure fuel from a first discharge hole 63 and a second discharge hole toward the first fuel pressurizing chamber 61 and the second fuel pressurizing chamber 52 respectively. The first discharge valve 61 and the second discharge valve include ball valves 35 and coil springs 62 respectively. The high-pressure fuel discharged from the first discharge hole 63 and the second discharge hole flows into a high-pressure fuel pipe 6 through a fuel pressure-feeding passage 67 inside a first pipe connector (a delivery valve holder) 65 and a fuel pressure-feeding passage inside a second delivery valve holder, and is supplied into the common rail 1. The fuel pressure-feeding passage 35, the first discharge hole 63 and the fuel pressure-feeding passage 67 constitute a high-pressure fuel pressure-feeding passage. The first discharge valve 61 is disposed in the high-pressure fuel pressure-feeding passage.

The housing 30 is made of metallic material and has the first housing portion 30*a* and the second housing portions 33, 34. The first housing portion 30*a* rotatably houses the camshaft 11, the cam ring 45 and the feed pump 12. The second housing portions 33, 34 house the first and second plungers 41, 42 respectively so that the plungers 41, 42 can reciprocate in a sliding manner. More specifically, the camshaft 11 is rotatably housed in the first housing portion 30*a* through a bearing so that the large diameter shaft portion 11*a* is inserted through the first housing portion 30*a*. The first housing portion 30*a* is formed with the fuel leading passage 16*a*, the fuel sump chamber 17*a*, the control fuel storage chamber 17*b* and the control fuel passage 16*b* of the low-pressure fuel passage formed in the housing 30. In addition, the first housing portion 30*a* is formed with the fuel lubrication passage 12*r* out of the fuel suction passage 12*h*, 15 and the return fuel passage 12*r*, 50.

The fuel leading passage 16*a*, the fuel sump chamber 17*a*, the control fuel storage chamber 17*b* and the control fuel passage 16*b* constitute a first low-pressure fuel passage. The suction quantity control electromagnetic valve 5 is disposed in the first low-pressure fuel passage.

Moreover, the first housing portion 30*a* is divided into a bearing housing portion (a bearing portion) 30*b* for rotatably bearing the camshaft 11, and a main body portion 30*c* for rotatably housing the feed pump 12. The bearing portion 30*b* and the main body portion 30*c* are integrated with each other after the camshaft 11 is inserted through the bearing portion 30*b* and the main body portion 30*c*. Alternatively, the first housing portion 30*a* may be formed in a single piece. In the present embodiment, the main body portion 30*c* is formed with the first low-pressure fuel passage 16*a*, 17*a*, 17*b*, 16*b*, the fuel suction passage 12*h*, 15 and the fuel lubrication passage 12*r*. The suction quantity control electromagnetic valve 5, the inlet 14 and the outlet 19 can be attached to the main body portion 30*c*.

The two second housing portions 33, 34 are fluid-tightly fixed to the upper and lower end surfaces of the first housing portion 30*a* in FIG. 1. The second housing portions 33, 34 and the first housing portion 30*a* define the cam chamber 50. The cam chamber 50 houses the sliding members such as the eccentric cam 44 and the cam ring 45, the plungers 41, 42 and the coil springs 48, 49 pressing the plate members 46, 47 against the cam ring 45. Two thrust washers 71 are interposed between ring-shaped inner wall surfaces of the cam chamber 50 and both end surfaces of the eccentric cam 44 along the thrust direction (the axial direction). Thus, the eccentric cam 44, the bush 43, the cam ring 45 and the plate member 46, 47 can rotate or reciprocate easily. Meanwhile, the position of the cam ring 45 in the thrust direction is determined. Each washer 71 has an external diameter corresponding to the area of the revolution of the cam ring 45. In order to prevent the washers 71 from rotating with the cam ring 45, the washers 71 should be preferably fixed to both end surfaces of the cam chamber 50 in the thrust direction.

As shown in FIG. 1, the second housing portions 33, 34 are formed with the sliding holes 33*a*, 34*a* respectively. The plungers 41, 42 are housed respectively inside the sliding holes 33*a*, 34*a* so that the plungers 41, 42 can reciprocate in a sliding manner. The second housing portions 33, 34 are formed with the fuel pressurizing chambers 51, 52, which are provided by the end surfaces of the plungers 41, 42, the inner peripheral surfaces of the sliding holes 33*a*, 34*a* and the suction valves 31, 32 (more specifically, the valve members 31*a*, 32*a*) respectively. The second housing portions 33, 34 are formed with the fuel suction passages 20 of the low-pressure fuel passage formed in the housing 30. More specifically, the second housing portions 33, 34 are formed with accommodation holes 37, 38 for accommodating the suction valves 31, 32, and the fuel suction passages 20 are connected to the accommodation holes 37, 38. The second housing portions 33, 34 are formed with the high-pressure fuel pressure-feeding passage 35, 63, 67. The discharge valve 61 and the delivery valve holder 65 are disposed in the high-pressure fuel pressure-feeding passage 35, 63, 67. The fuel suction passage 20 provides a second low-pressure fuel passage.

The second housing portions 33, 34 and the plungers 41, 42 constitute pump elements (high-pressure supply pumps) of the supply pump 4 respectively. The second housing portions 33, 34 constituting the pump elements are cylinder heads. The second housing portions 33, 34 are made of metallic material having mechanical strength such as abrasion resistance and seizing resistance. The first housing portion 30*a* except the bearing for rotatably holding the camshaft 11 is made of aluminum such as die-cast aluminum or aluminum alloy.

Next, operation of the supply pump 4 having the above structure will be explained. If the camshaft 11 is rotated by the engine, the feed pump 12 is driven by the rotational movement of the camshaft 11. If the feed pump 12 starts the drive, the fuel in the fuel tank 9 is introduced into the fuel introduction passage 15 through the fuel supply passage 10, the fuel filter 13 and the inlet 14, and is drawn into the suction side of the feed pump 12. The feed pump 12 pressurizes the drawn fuel to a predetermined pressure and discharges the low-pressure fuel into the fuel sump chamber 17*a* of the suction quantity control electromagnetic valve 5 through the fuel leading passage 16*a*. At that time, since the eccentric cam 44 integrated with the camshaft 11 rotates, the cam ring 45 revolves along a predetermined substantially circular passage of the cam 44. As a result, the plate members 46, 47 reciprocate on the upper and lower end surfaces 45*a* of the cam ring 45 in FIG. 1. Accordingly, the first and second plungers 41, 42 reciprocate inside the sliding holes 33*a*, 34*a* in the vertical direction in FIG. 1. Thus, the first and second plungers 41, 42 pressurize the fuel in the first and second pressurizing chambers 51, 52 and pressure-feed the high-pressure fuel. More specifically, if the first plunger 41 moves from a top dead center to a bottom dead center in the sliding hole 33*a* in a suction stroke, the low-pressure fuel discharged from the feed pump 12 opens the first suction valve 31 and flows into the first fuel pressurizing chamber 51. Then, the first plunger 41 having reached the bottom dead center moves toward the top dead center in the sliding hole 33*a* in a pressure-feeding stroke, and the fuel pressure in the first fuel pressurizing chamber 51 is increased in accordance with the increase in the lifting degree of the first plunger 41. Likewise, if the second plunger 42 moves from a top dead center to a bottom dead center in the sliding hole 34*a* in a suction stroke, the low-pressure fuel discharged from the feed pump 12 opens the second suction valve 32 and flows into the second fuel pressurizing chamber 52. Then, the second plunger 42 having reached the bottom dead center moves toward the top dead center in the sliding hole 34*a* in a pressure-feeding stroke, and the fuel pressure in the second fuel pressurizing chamber 52 is increased in accordance with the increase in the lifting degree of the second plunger 42. If the first discharge valve 61 is opened by the increased fuel pressure, the high-pressure fuel pressurized in the fuel pressurizing chamber 51 flows out of the fuel pressure-feeding passage 67 in the delivery valve holder 65 through the fuel pressure-feeding passage 35 and the discharge hole 63. Then, the high-pressure fuel flowing out of the fuel pressure-feeding passage 67 is pressure-fed into the common rail 1 through the high-pressure fuel pipe 6.

The eccentric cam 44 is eccentric with respect to the camshaft 11. Therefore, as shown in FIG. 1, the first plunger 41 and the second plunger 42 reciprocate alternately. In FIG. 1, the first plunger 41 is in a state of a maximum cam lift (a maximum plunger lift), or in an upper dead center state, after moving upward. The second plunger 42 is in a state of a minimum cam life (a minimum plunger lift), or in a bottom dead center state, after moving upward in FIG. 1.

In the supply pump 4, part of the low-pressure fuel drawn by the feed pump 12 is provided as the lubrication fuel to the cam chamber 50 through the fuel lubrication passage 12*r*. The cam chamber 50 houses the sliding members such as the eccentric cam 44 and the cam ring 45 and the reciprocating members such as the plungers 41, 42 and the plate members 46, 47. The operating members such as the sliding members and the reciprocating members are lubricated with the lubrication fuel.

Next, an effect of the present embodiment will be explained.

Figure 5:
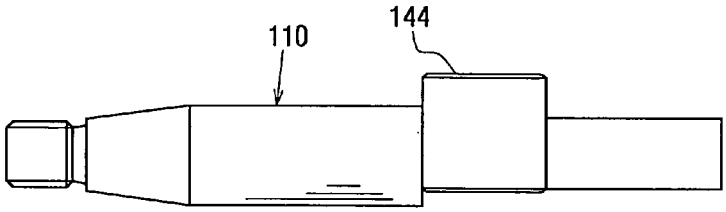
FIG. 5 RELATED ART
FIG. 5 is a view showing a camshaft of a related art.

If the water and the like are accidentally mixed into the fuel, there is a possibility that poor lubrication (deterioration of lubricity) occurs among the operating members including the sliding members and the reciprocating members in the cam chamber 50. If the poor lubrication occurs between the plungers 41, 42 and the inner peripheral surfaces of the sliding holes 33*a*, 34*a*, defective operation of the plungers 41, 42 (more specifically, slight seizing of the plungers 41, 42) occurs. Depending on the degree of the defective operation of the plungers 41, 42 (or a degree of the seizing of the plungers 41, 42), the seizing can occur between the sliding surfaces of the plungers 41, 42 (more specifically, the plate members 46, 47) and the cam ring 45. If the degree of the seizing increases, there is a possibility that an excessive thrust load is applied to the cam ring 45 and the plungers 41, 42 are damaged (for instance, a part of the plate members 46, 47 integrated with the plungers 41, 42 breaks and drops). In the supply pump employing the conventional camshaft (the main shaft) 110 shown in FIG. 5, if the part (the fragment) of the broken plungers 41, 42 moves through the inside of the cam chamber 50 and gets stuck into a clearance between the cam ring 45 and the housing 30 (more specifically, the inner peripheral surface of the cam chamber 50 of the first housing portion 30*a*), the cam ring 45 attempts to rotate while the fragment is stuck into the clearance, since the rotational movement of the eccentric cam 144 rotated by the engine is transmitted to the cam ring 45. In this case, there is a possibility that the first housing portion 30*a* made of the aluminum is damaged and the damage spreads.

To the contrary, in the supply pump 4 of the present embodiment, the camshaft 11 and the eccentric cam 44 are formed separately and are connected through the connecting portion 11*bs*, 44*s*, which has the connection eliminating function as the safety device, so that the camshaft 11 and the eccentric cam 44 can rotate integrally. More specifically, the strength of the connecting portion 11*bs*, 44*s* is set to a value lower than the damage strength of the housing 30 (more specifically, the damage strength of the first housing portion 30*a*). Thus, the connected state of the connecting portion 11*bs*, 44*s* of the camshaft 11 and the eccentric cam 44 is eliminated before the housing 30 is damaged. Thus, the camshaft 11 and the eccentric cam 44 are separated from each other and the camshaft 11 freely turns in the cam 44. As a result, even if the camshaft 11 is driven by the engine, the rotational movement of the camshaft 11 is not transmitted to the eccentric cam 44, and the function of the supply pump 4 as the fuel injection pump is stopped. Thus, the damage of the housing 30 can be prevented and the spread of the damage can be prevented.

The strength of the connecting portion 11*bs*, 44*s* should be preferably set so that the connected state of the connecting portion 11*bs*, 44*s* is eliminated when the seizing occurs between the sliding surfaces of the cam ring 45 and the plungers 41, 42 (more specifically, the plate members 46, 47). Thus, the damage of the operating members such as the plungers 41, 42 itself due to the seizing of the sliding surfaces of the cam ring 45 and the plungers 41, 42 can be prevented. Therefore, even if the defective operation of the plungers 41, 42 (the slight seizing of the plunger 41, 42 and the like) occurs, the damage of the housing 30 can be prevented.

Even in the case where the seizing occurs between the sliding surfaces of the cam ring 45 and the plungers 41, 42, further damage can be prevented. Thus, the supply pump with excellent safety can be provided.

Moreover, the strength of the connecting portion 11*bs*, 44*s* should be preferably set so that the connected state of the connecting portion 11*bs*, 44*s* is eliminated when the seizing occurs between the plungers 41, 42 and the inner peripheral surfaces of the sliding holes 33*a*, 34*a*. Thus, if the seizing occurs between the plungers 41, 42 and the inner peripheral surfaces of the sliding holes 33*a*, 34*a*, the connected state of the connecting portion 11*bs*, 44*s* is eliminated and the camshaft 11 and the eccentric cam 44 are separated from each other. Accordingly, the camshaft 11 freely turns in the cam 44. As a result, the production of the fragments of the plungers 41,42 can be prevented.

Also in the case where the seizing occurs between the plungers 41, 42 and the inner peripheral surfaces of the sliding holes 33*a*, 34*a*, further damage can be prevented. Thus, the supply pump with the excellent safety can be provided.

In the case where the extraneous matters are mixed into the fuel, if the extraneous matters get stuck into a seat portion of one of the discharge valves 61, which alternately discharge the fuel pressurized in the two fuel pressurizing chambers 51, 52 as in the supply pump 4 of the present embodiment, the discharge valve 61, into which the extraneous matters get stuck, is brought to a continuously opened state. Accordingly, the high pressure of the fuel accumulated in the common rail 1 is continuously applied to the plunger corresponding to the discharge valve 61 in the continuously opened state. As a result, there is a possibility that the plunger is brought to a poorly lubricated state.

To the contrary, in the supply pump 4 of the present embodiment, when the defective operation of the plunger is caused by the poor lubrication of the plunger, the function of the fuel injection pump is stopped by separating the camshaft 11 and the eccentric cam 44 from each other. Thus, the damage of the housing can be prevented, and the spread of the damage can be prevented.

In the present embodiment, a clearance between the housing 30 (more specifically, the inner peripheral surface of the cam chamber 50 of the first housing portion 30*a*) and the cam ring 45 need not be increased. Therefore, a significant increase in the body size is unnecessary and an increase in the cost can be inhibited. Moreover, mountability to the vehicle and the like is not deteriorated.

(Second Embodiment)

Next, a supply pump 4 according to a second embodiment of the present invention will be explained based on FIGS. 4A and 4B.

Figure 4A:
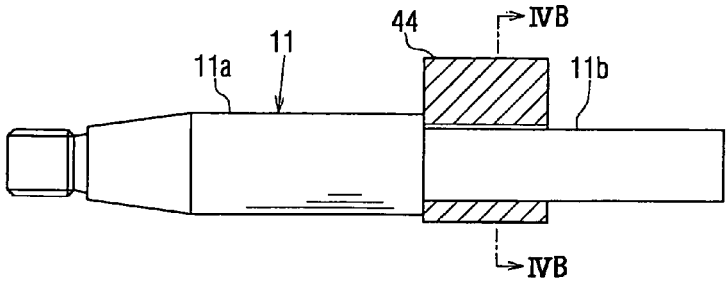
FIG. 4A is a longitudinal partly sectional view showing a main shaft and a cam of a fuel injection pump according to a second embodiment of the present invention.
Figure 4B:
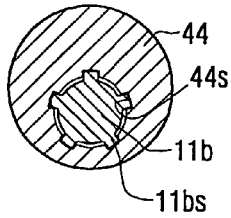
FIG. 4B is a cross-sectional view showing the main shaft and the cam of FIG. 4A taken along the line IVB—IVB.

In the second embodiment, fitting structure constituted by spline teeth and grooves shown in FIGS. 4A and 4B is employed as the connecting portion having the connection eliminating function as the safety device, instead of the thread fastening structure constituted by the male screw and the female screw of the first embodiment.

More specifically, as shown in FIGS. 4A and 4B, multiple (five in FIG. 4B) spline teeth 11*bs* and multiple (five in FIG. 4B) spline grooves 44*s* are formed on an outer periphery of the small diameter shaft portion 11*b* and an inner periphery of the eccentric cam 44 respectively. The spline teeth 11*bs* and the spline grooves 44*s* can mesh with each other. As shown in FIG. 4B, as radial clearance is formed between the inner periphery of the eccentric cam 44 and the outer periphery of the small diameter shaft portion 11*b*.

In the above structure, if the spline teeth 11*bs* are sheared and broken, the connected state of the connecting portion 11*bs*, 44*s* is eliminated and the camshaft 11 and the cam 44 are separated from each other. As a result, the camshaft 11 freely turns in the cam 44.

The above structure also can exert an effect similar to that of the first embodiment.

(Modifications)

In the above embodiments, the supply pump has two plungers. An effect similar to the effects of the above embodiments can also be exerted by applying the present invention to any other type of supply pump having multiple plungers.

Moreover, in the above embodiments, the present invention is applied to the supply pump used in the common rail type fuel injection system. Alternatively, the present invention may be applied to any other type of supply pump having structure, in which a camshaft is rotated by an engine and an eccentric cam is rotated by the camshaft so that a cam ring revolves and plungers reciprocate in accordance with the revolution of the cam ring to pressurize low-pressure fuel in fuel pressurizing chambers and to discharge high-pressure fuel pressurized to a high pressure corresponding to a fuel injection pressure.

The present invention should not be limited to the disclosed embodiments, but may be implemented in many other ways without departing from the spirit of the invention.

What is claimed is:

1. A fuel injection pump comprising:

a main shaft rotated by an internal combustion engine;

a cam provided separately from the main shaft, the cam being formed with a connecting portion connected with the main shaft so that the cam can rotate integrally with the main shaft;

a cam ring revolving around the main shaft so that the cam ring rotates with respect to the cam along an outer periphery of the cam;

a housing for rotatably housing the cam and the cam ring, the housing being formed with a fuel pressurizing chamber; and a plunger reciprocating in accordance with the revolution of the cam ring to pressurize and to pressure-feed fuel, which is drawn into the fuel pressurizing chamber, wherein the connecting portion has strength lower than a damage strength of the housing, at which the housing is damaged, whereby when a force greater than said connecting portion strength blocks rotation of the cam with the main shaft, the main shaft can rotate relative to the cam substantially without the housing being damaged.

2. The fuel injection pump as in claim 1, wherein the strength of the connecting portion is set so that the connected state of the connecting portion is eliminated when seizing occurs between sliding surfaces of the cam ring and the plunger.

3. The fuel injection as in claim 1, wherein the strength of the connecting portion is set so that the connected state of the connecting portion is eliminated when seizing occurs between the plunger and an inner peripheral surface of a plunger sliding hole, the plunger and the plunger sliding hole providing the fuel pressurizing chamber.

4. The fuel injection pump as in claim 1, wherein the connecting portion connects the cam to the main shaft through thread fastening.

5. The fuel injection pump as in claim 1, wherein the connecting portion connects the cam to the main shaft through a spline formed between the main shaft and the cam.

6. The fuel injection pump as in claim 1, wherein the housing houses a discharge valve between the fuel pressurizing chamber and a common rail for streaming high-pressure fuel to the common rail if a fuel pressure in the fuel pressurizing chamber exceeds a fuel pressure in the common rail, the common rail accumulating the fuel, which is pressurized in the fuel pressurizing chamber through the movement of the plunger and is pressure-fed through the movement of the plunger, at a high pressure.

7. A fuel injection pump comprising:

a main shaft rotated by an internal combustion engine;

a cam provided separately the main shaft, the cam being formed with a connecting portion connected with the main shaft so that the cam can rotate integrally with the main shaft;

a cam ring revolving around the main shaft so that the cam ring rotates with respect to the cam along an outer periphery of the cam;

a housing for rotatably housing the cam and the cam ring, the housing being formed with a fuel pressurizing chamber; and a plunger reciprocating in accordance with the revolution of the cam ring to pressurize and to pressure-feed fuel, which is drawn into the fuel pressurizing chamber, wherein the connecting portion has strength set so that the connected state of the connection portion is eliminated when seizing occurs between sliding surfaces of the cam ring and the plunger, whereby the main shaft can rotate relative to the cam.

8. The fuel injection pump as in claim 7, wherein the connecting portion connects the cam to the main shaft through thread fastening.

9. The fuel injection pump as in claim 7, wherein the connecting portion connects the cam to the main shaft through a spline formed between the main shaft and the cam.

10. The fuel injection pump as in claim 7, wherein the housing houses a discharge valve between the fuel pressurizing chamber and a common rail for streaming high-pressure fuel to the common rail if a fuel pressure in the fuel pressurizing chamber exceeds a fuel pressure in the common rail, the common rail accumulating the fuel, which is pressurized in the fuel pressurizing chamber through the movement of the plunger and is pressure-fed through the movement of the plunger, at a high pressure.

11. A fuel injection pump comprising:

a main shaft rotated by an internal combustion engine;

a cam provided separately from the main shaft, the cam being formed with a connecting portion connected with the main shaft so that the cam can rotate integrally with the main shaft;

a cam ring revolving around the main shaft so that the cam ring rotates with respect to the cam along an outer periphery of the cam;

a housing for rotatably housing the cam and the cam ring, the housing being formed with a fuel pressurizing chamber; and a plunger reciprocating in accordance with the revolution of the cam ring to pressurize and to pressure-feed fuel, which is drawn into the fuel pressurizing chamber, wherein the connecting portion has strength set so that the connected state of the connecting portion is eliminated when seizing occurs between the plunger and an inner peripheral surface of a plunger sliding hole, the plunger and the plunger sliding hole providing the fuel pressurizing chamber, whereby the main shaft can rotate relative to the cam.

12. The fuel injection pump as in claim 11, wherein the connecting portion connects the cam to the main shaft through thread fastening.

13. The fuel injection pump as in claim 11, wherein the connecting portion connects the cam to the main shaft through a spline formed between the main shaft and the cam.

14. The fuel injection pump as in claim 11, wherein the housing houses a discharge valve between the fuel pressurizing chamber and a common rail for streaming high-pressure fuel to the common rail if a fuel pressure in the fuel pressurizing chamber exceeds a fuel pressure in the common rail, the common rail accumulating the fuel, which is pressurized in the fuel pressurizing chamber through the movement of the plunger and is pressure-fed through the movement of the plunger, at a high pressure.

* * * * *